United States Patent [19]

Spencer

[11] Patent Number: 4,874,943

[45] Date of Patent: Oct. 17, 1989

[54] MASS SPECTROMETER ION EXCITATION SYSTEM

[75] Inventor: Robert B. Spencer, Madison, Wis.

[73] Assignee: Nicolet Instrument Corporation, Madison, Wis.

[21] Appl. No.: 695,847

[22] Filed: Jan. 28, 1985

[51] Int. Cl.[4] ..... H01J 49/36

[52] U.S. Cl. ..... 250/281; 250/282; 250/291

[58] Field of Search ..... 250/281, 282, 290, 291

[56] References Cited

U.S. PATENT DOCUMENTS

| | | | |
|---|---|---|---|
| 3,461,381 | 8/1969 | Nelson et al. | 250/291 |
| 3,511,986 | 5/1970 | Llewellyn | 250/291 |
| 3,742,212 | 6/1973 | McIver | 250/291 |
| 3,937,955 | 2/1976 | Comisarow et al. | 250/291 |
| 3,984,681 | 10/1976 | Huntress | 250/291 |

*Primary Examiner*—Bruce C. Anderson
*Attorney, Agent, or Firm*—Kinney & Lange

[57] ABSTRACT

Gaseous ions trapped within an analyzer cell of an ion cyclotron resonance mass spectrometer are excited into resonance by a swept radio-frequency electric field having an envelope of trapezoidal shape. The envelope includes an onset region which ramps linearly from a zero level to a non-zero constant-amplitude level, a constant-amplitude region having the non-zero constant-amplitude level, and a termination region which ramps linearly from the constant-amplitude level to the zero level. The field has a generally constant-amplitude power spectrum and imparts relatively uniform energy to ions having natural cyclotron frequencies of interest.

36 Claims, 3 Drawing Sheets

RELATIVE SIGNAL AMPLITUDE
100%
TIME IN MICROSECONDS
FREQ. IN KHZ
20
22
24
30
32
34
40
42
44
46
48
50
60
62
64

MASS SPECTROMETER ION EXCITATION SYSTEM

BACKGROUND OF THE INVENTION

1. Field of the Invention

The present invention relates to spectroscopy. In particular, the present invention is an improved method and apparatus for exciting ions into resonance within an ion cyclotron resonance mass spectrometer.

2. Description of the Prior Art

Ion Cyclotron Resonance Mass Spectrometry (ICR/MS) is a well known technique for detecting gaseous ions and is described in U.S. Pat. Nos. 3,742,212 to McIver, Jr. and 3,937,955 to Comisarow et al. Gaseous ions formed from a sample are trapped within an analyzer cell by a static electric field. These ions are subjected to a magnetic field and are thereby constrained to move in circular orbits in a plane perpendicular to the magnetic field. The frequency of the orbital motion is termed the "natural cyclotron frequency", and for any given ion is dependent upon the mass and charge of the ion, and the strength of the magnetic field.

Ions to be analyzed are then excited into coherent orbits through the application of a radio-frequency (rf) electric field. Ions whose natural cyclotron frequency is matched by the frequency of the applied rf electrical field will absorb energy from the electric field and be accelerated to larger orbital radii and higher kinetic energy levels. These ions are said to be in resonance.

As the ions resonate within the analyzer cell, an image current is induced in electrode plates positioned on opposite sides of the cell. The image current is detected and converted to a frequency-domain spectrum whose peaks can be correlated with the mass-to-charge ratio and abundance of the gaseous ions being analyzed. Ions of different mass to charge ratios have different resonant frequencies they can be distinguished one from another.

In a typical ICR/MS instrument, the ions are excited into resonance by a swept-frequency rf electric field. The electric field is produced by a swept-frequency rf signal which is applied to electrode plates positioned on opposite sides of the analyzer cell. A swept-frequency signal is one having a frequency which increases or otherwise varies with time. The frequency of the rf signal is usually made to increase linearly with time, although other functions, such as a logorithmic variation, can be used. This prior art excitation function is described by the following formula:

$$E_{Excitation}=E_o \sin((F_o+F't)t+\theta_o)$$

where:

$E_{Excitation}$ is the excitation signal applied to the ions.

$E_o$ is the amplitude of the excitation signal.

$F_0$ is the initial frequency of the excitation signal.

F' is the rate of change in frequency of the excitation signal.

t is time.

$\theta_o$ is the initial phase of the excitation signal.

The amplitude, $E_o$, of the excitation signal is constant with time. The excitation function therefore has an envelope of rectangular shape which is applied for a period $t_0$ to $t_l$ such that:

$$E_{Excitation} = 0 \text{ for } t < t_0$$
$$= 0 \text{ fo } t > t_1$$

A major problem encountered in mass spectral analysis of gaseous ions is the variation in the energy of the effective rf field used to bring the ions into resonance. A Fourier Transform of the excitation function described above reveals that the power spectrum varies significantly over the frequency range of interest. This is due to the rectangular envelope of the swept rf signal and field which abruptly switch on and off at times $t_0$ and $t_1$, respectively. These variations in the power spectrum produce a lack of uniformity in the energy imparted to ions of differing frequencies. Errors in the determination of physical parameters of the ions, such as mass and abundance of ions of a given mass-to-charge ratio, are a direct consequence. This in turn affects the accuracy of ICR/MS measurements. To compound matters, it is known that ions of different orbital radii are affected differently by the rf electric field. Experiments have shown that perturbations in the natural cyclotron frequency of these ions is due in part to variations in the power spectrum of the excitation signal.

The problems described above are well known and have been previously addressed. In addition to the excitation method described above, the Comisarow et al Patent suggests several alternatives. One such method involves applying a sine-wave pulse to one of the electrode plates of the analyzer cell. It is stated that the Fourier Transform of this pulse is a frequency function which is essentially flat over the frequency range $\pm\frac{1}{4}\tau$ Hz centered at the frequency of the sine-wave pulse. A second and related alternative is to apply a dc pulse having a duration of about 100 nsec. It is suggested that it is possible to achieve an essentially uniform irradiation field over a frequency range from about dc to about 2M Hz by the application of such a pulse.

Neither of these alternatives is workable. As the specification of the Comisarow et al Patent notes, the amplitude of such pulses must be very large if they are to be adequate to excite ions over the entire frequency range. As a practical matter it is virtually impossible to use this technique for this very reason. Furthermore, these methods would produce no better power uniformity than the swept-frequency approach.

The determination of relative abundance of ions is based on the strength of the image current observed for each given ionic species present in the analyzer cell. Accuracy of this determination requires that each ion be subjected to excitation of the same effective intensity from the rf electrical field. Clearly, currently known apparatus and methods for exciting ions have power spectra which vary over frequency. It would be desirable to excite the ions with an excitation signal which is constant with frequency. The result would be a significant increase in the accuracy of ICR/MS measurements.

SUMMARY OF THE INVENTION

An ion cyclotron resonance mass spectrometer includes means for trapping gaseous ions within an analyzer cell, means for exciting the ions into resonance, and means for detecting the ions. The improvement in the means for exciting the ions into resonance comprises means for producing a swept radio-frequency field having a generally constant-amplitude power spectrum over a range of frequencies of interest.

In preferred embodiments, the means for producing the swept radio-frequency field causes the field to have an envelope having an onset region which varies linearly from a zero amplitude level to a non-zero constant-amplitude level. In other embodiments, the means for producing the swept radio-frequency field causes the field to have an envelope having a termination region which varies linearly from the non-zero constant amplitude level to the zero amplitude level.

In yet other embodiments, both the onset and termination regions have a duration of 20 to 100 microseconds. The frequency range of interest is from 0 to 2M Hz. Variations in the power spectrum of the improved swept rf electric field range from 99% to 102% of a mid-range frequency value.

DETAILED DESCRIPTION OF THE PREFERRED EMBODIMENTS

Figure 1:
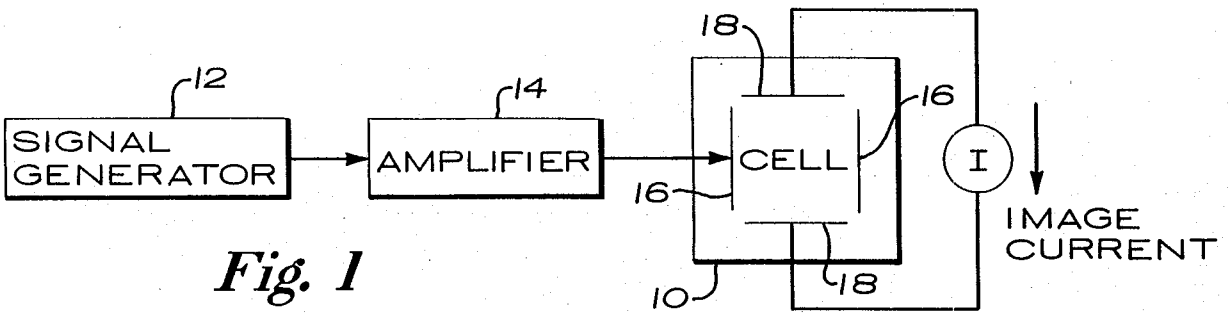
FIG. 1 is a block diagram representation of the ion excitation and detection apparatus of an ion cyclotron resonance mass spectrometer.

Apparatus for exciting and detecting ions within an ion cyclotron resonance mass spectrometer are illustrated generally in FIG. 1. Gaseous ions of a sample are trapped within analyzer cell 10 by static trapping fields (not shown) in accordance with well known techniques. A static magnetic field (also not shown) constrains the ions movement to circular orbits about a plane perpendicular to the direction of the magnetic field. Signal generator 12 is configured to produce a swept-frequency radio-frequency (rf) electric signal representative of the excitation function used to bring the ions into resonance. The swept rf signal is amplified by amplifier 14 and applied to electrode plates 16, shown positioned on opposite sides of analyzer cell 10, the signal being 180° phase shifted from one to the other of plates 16. The resultant swept rf electric field produced within analyzer cell 10 excites ions having a natural cyclotron frequency equal to the instantaneous frequency of the rf electric field into resonance. Resonant ions induce an image current I in detector plates 18. Once detected in accordance with well known techniques, the image current is converted to a frequency domain spectrum, the peaks of which are correlated with the mass-to-charge ratio and abundance of the gaseous ions being analyzed.

Signal generator 12 must be capable of producing a swept rf signal having frequency components which correspond to the natural cyclotron frequency of all ions desired to be put into resonance and detected. Typically, the natural cyclotron frequencies of interest are in the 0–2 megahertz (MHz) range. Although the present invention is not so limited, this range will be used hereafter for purposes of example.

The frequency sweep of the rf signal produced by signal generator 12 is usually linear with time. If, for example, the duration of the rf signal is 2,000 microseconds, the frequency of the signal will increase from 0–2M Hz at a rate of 1,000M Hz per second. Non-linear frequency sweeps (e.g., logarithmic) are equally well suited. Durations of the swept rf signal also vary to meet particular applications although durations of 1,000 to 2,000 microseconds are typical.

The swept rf signal produced by signal generator 12 is sufficiently amplified by amplifier 14 to produce an electric field of desired magnitude within analyzer cell 10. Amplifier 14 is a broad-band amplifier, capable of amplifying frequency components corresponding to all natural cyclotron frequencies of interest. Such amplifiers are well known.

Figures 2A, 2B, 3A, 3B:
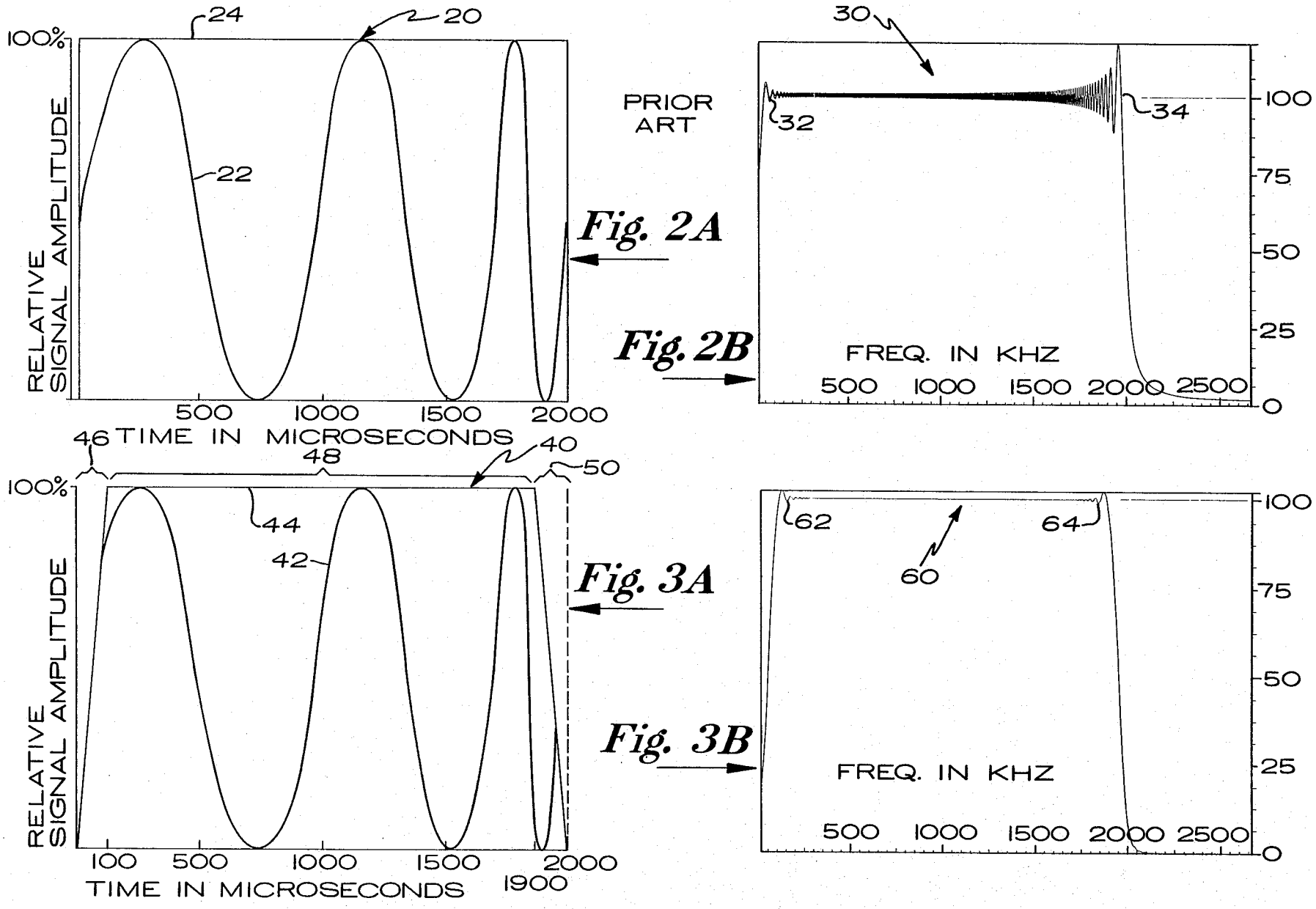
PRIOR ART Fig. 2A
FIG. 2A is an illustration of the excitation function used in the prior art.
FIG. 2B is an illustration of a Fourier Transform and power spectrum of the prior art excitation function illustrated in FIG. 2A.
FIG. 3A is an illustration of the excitation function of the present invention.
FIG. 3B is an illustration of a Fourier Transform and power spectrum of the excitation function of the present invention illustrated in FIG. 3A.

FIG. 2A is a graphic illustration of prior art excitation function 20. Excitation function 20 is shown plotted in terms of relative amplitude as a function of time, f(t). Excitation function 20 is therefore representative of both the swept rf signal produced by signal generator 12 and the swept rf electric field within analyzer cell 10, each being proportional to the other. As shown in FIG. 2A, prior art excitation function 20 is comprised of swept rf signal (or field) 22 having an envelope 24. It is to be understood that swept rf signal 22 is shown only for purposes of example and is not drawn to scale. In keeping with the previous example, excitation function 20 is shown having a duration of 2,000 microseconds.

As previously described, envelope 24 of excitation function 20 is rectangular in shape since swept rf signal 22 is switched on and off at the 0 and 2,000 microsecond times, respectively. FIG. 2B graphically illustrates the Fourier Transform of rectangular prior art excitation function 20. The Fourier Transform represents the power spectrum 30 of excitation function 20, and is a plot of the relative intensity of excitation function 20 as a function of frequency, F(w). As shown in FIG. 2B, swept rf signal 22 of excitation function 20 includes frequency components which extend between 0 and 2M Hz.

The relative intensity of power spectrum 30 at each individual frequency is directly proportional to the amount of energy imparted to ions of that particular natural cyclotron frequency as those ions are brought into resonance. It is evident from FIG. 2B that this energy varies considerably over the range of frequencies of interest. Relative intensity of the power spectrum at the mid-range frequency of 1M Hz is plotted as the 100% level. Near the low end of the frequency range, illustrated generally at 32, relative intensity of the power spectrum varies between 104% and 98% of the mid-range value. Variations in the power spectrum near the upper end of the frequency range, illustrated generally at 34, are much more severe. Relative intensity in this region varies between 88% and 118% of the mid-range value. Furthermore, these variations remain substantial over the 1.5 to 2M Hz frequency range, approximately 25% of the range of frequencies of interest. As shown, variations of about 2% continue throughout the frequency range from 250K Hz to 1.5M Hz. All these variations induce considerable errors into the accuracy of measurements made by mass spectrometers utilizing excitation function 20.

Excitation function 40 of the present invention is illustrated generally in FIG. 3A. Like that of the prior art, excitation function 40 is plotted in terms of relative amplitude as a function of time, f(t). As such, excitation function 40 is representative of both the swept rf signal produced by signal generator 12, and the swept rf electric field within analyzer cell 10. Each is proportional to the other. As shown in FIG. 3A, excitation function 40 is comprised of swept rf signal (or field) 42 (not drawn to scale) which has an envelope 44. For purposes of example, excitation function 40 is shown having a duration of 2,000 microseconds.

The essence of the present invention resides in the realization that accuracy of measurements made by a mass spectrometer can be greatly enhanced if the power spectrum of the excitation function used is generally constant over the range of natural cyclotron frequencies which are desired to be detected. To this end, envelope 44 of excitation function 40 is trapezoidal in shape and includes onset region 46, constant-amplitude region 48, and termination region 50. Onset region 46 of envelope 44 gradually rises from the zero relative amplitude level to the 100% relative amplitude level. Amplitude of envelope 44 remains at the 100% level throughout constant-amplitude region 48. During termination region 50, envelope 44 gradually falls from the 100% relative amplitude level to the zero relative amplitude level. In the embodiment shown in FIG. 3A, envelope 44 rises linearly from the zero level to the 100% level during onset region 46. Similarly, envelope 44 falls linearly from the 100% level to the zero level during termination region 50. Computer modeling has shown that durations on the order of 20 to 100 microseconds for both onset region 46 and termination region 50 provide good results. These values correspond to durations of approximately 2.5% to 5% of the duration of excitation function 40.

A Fourier Transform representing power spectrum 60 of modified excitation function 40 is illustrated in FIG. 3B. Power spectrum 60 is a plot of the relative intensity as a function of frequency, F(w), and represents the energy imparted to ions of each respective natural cyclotron frequency by modified excitation function 40. As shown in FIG. 3B, power spectrum 60 has a generally constant amplitude over the frequency range of interest relative to power spectrum 30 of prior art excitation function 20. With respect to the mid-range frequency value of 1M Hz, which is taken to be 100% relative intensity, variations in power spectrum 60 range between 102% and 99% at both the lower and upper ends of the frequency range, illustrated generally at 62 and 64, respectively. The reduction in the amplitude variations are especially significant at upper end 64 of the frequency range. In contrast to power spectrum 30 of prior art excitation function 20 in which variations of large magnitude occurred over the upper 500K Hz range, variations in the upper frequency range 64 of power spectrum 60 are virtually nonexistent. Furthermore, variations throughout the mid-range frequency band are well under 1%, virtually nonexistent with respect to the variations throughout power spectrum 30 of prior art excitation function 20.

The relatively constant-amplitude of power spectrum 60 is achieved at the expense of power spectrum transition zone width. As shown in FIG. 2B, power spectrum 30 of prior art excitation function 20 reaches its 100% relative intensity level by the time swept rf signal 20 has attained a frequency of approximately 50K Hz. In contrast, power spectrum 60 of modified excitation function 40 reaches its 100% amplitude level as swept rf signal 40 approaches 110K Hz. The magnitude of the power spectrum variations are, in general, inversely related to rise time of the excitation function, larger variations being produced by an excitation function which quickly rises to its maximum value (e.g., prior art excitation function 20). The longer the duration of onset and termination regions 46 and 50, respectively, the less power spectrum 60 will vary about its mid-range frequency value, and the longer the time (or greater the frequency) it takes for the power spectrum to reach its mid-range frequency value. These trade-offs must be made in such a way to optimize the performance requirements of the ICR/MS instrument.

A constant amplitude power spectrum is required only over a given range of frequencies, those corresponding to the natural cyclotron frequencies of the ions of interest. By lengthening the range of frequencies over which rf signal 40 is swept, and including onset and termination regions 46 and 50 as described above, power spectrum 60 can be made relatively constant for frequencies well beyond 2M Hz. This lengthening of the frequency sweep is, of course, not possible at the low frequency end since in reality the range cannot be extended below zero Hz. However, the inherent characteristics of a sweep beginning at zero Hz resembles a partially shaped excitation envelope This is the reason the variations near zero Hz of power spectrum 30, as shown in FIG. 2B, are not as great as those near upper end 34 of the frequency range. Computer modeling like that used to produce FIGS. 2B and 3B has shown that if swept rf signal 42 is shaped only over the upper 5% of its frequency range, variations in the power spectrum range between 98% and 104% of the mid-range frequency value. Similar variations are produced for an excitation function having a termination region of 2.5% variation. The magnitude of these variations are considerably less than those of the prior art.

Preferred embodiments of signal generator 12 are illustrated in FIGS. 4–8. With the exception of the embodiment shown in FIG. 8, each embodiment of signal generator 12 includes three sections A first section produces a swept frequency rf signal A signal indicative of the shape of the excitation envelope is produced by a second section The swept rf signal is modulated by the signal representative of the envelope at the third section to produce a signal representative of the modified excitation function. The circuit elements and modulation techniques described below are well known and easily implemented in a variety of configurations. All of these circuit elements are commercially available in integrated circuit and component form They are, therefore, described solely with reference to block diagrams.

Figures 4, 5, 6:
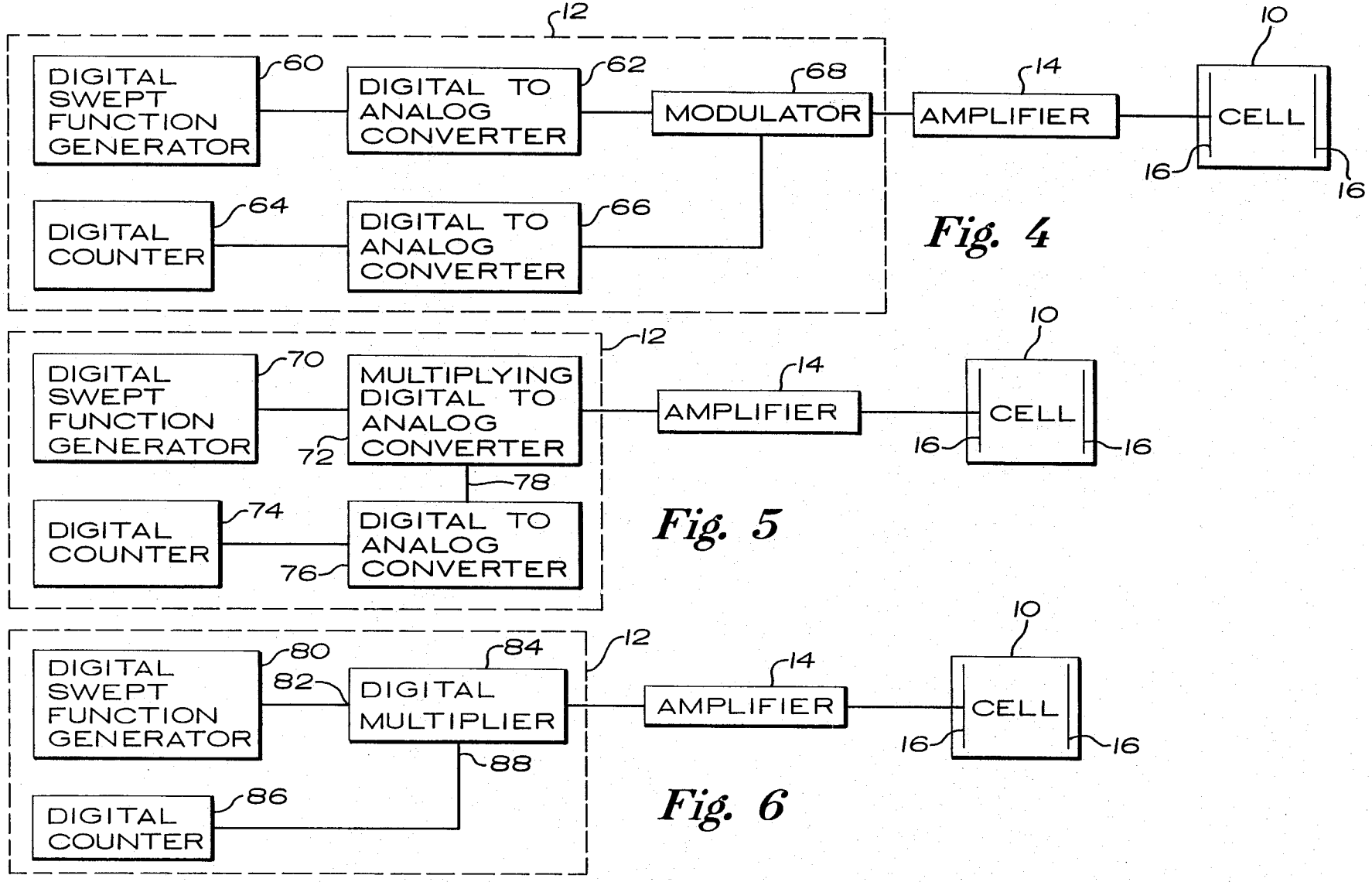
FIG. 4 is a block diagram representation of a first preferred embodiment of the signal generator.
FIG. 5 is a block diagram representation of a second preferred embodiment of the signal generator.
FIG. 6 is a block diagram representation of a third preferred embodiment of the signal generator.

A first embodiment of signal generator 12 is illustrated in FIG. 4. As shown, signal generator 12 includes digital swept function generator 60, digital-to-analog (D/A) converter 62, digital counter 64, digital-to-analog (D/A) converter 66, and modulator 68. Digital swept function generator 60 produces a digital signal representative of a swept frequency rf signal. D/A converter 62 converts this signal into an analog signal.

Digital counter 64 is programmed to produce a digital signal representative of envelope 44 of modified excitation function 40. D/A converter 66 converts this digital signal into an analog signal. Modulator 68 modulates the analog swept rf signal by the envelope to produce the swept rf signal representative of excitation function 40. The swept rf signal is amplified by amplifier 14 and applied to electrode plates 16 of analyzer cell 10.

A second embodiment of signal generator 12 is illustrated in FIG. 5. Included are digital swept function generator 70, multiplying digital-to-analog (D/A) converter 72, digital counter 74, and digital-to-analog (D/A) converter 76. Digital swept function generator 70 produces a digital signal representative of a swept frequency rf signal. This signal is input to multiplying D/A converter 72. Digital counter 74 produces a digital signal representative of the envelope 44 of modified excitation function 40. D/A converter 76 converts this digital signal to analog form. The analog signal representative of envelope 44 is applied to multiplying input 78 of multiplying D/A converter 72. Multipling D/A converter 72 converts the digital signal representative of the swept rf signal into analog form while at the same time multiplying its magnitude as a function of the signal present at multiplying input 78. The output of multiplying D/A converter 72 is a swept rf excitation signal representative of excitation function 40. This signal is amplified by amplifier 14 and applied to electrode plates 16 of analyzer cell 10.

FIG. 6 illustrates a third embodiment of signal generator 12. Digital swept function generator 80 produces a digital signal representative of a swept frequency rf signal. This signal is applied to first input 82 of digital multiplier 84. Digital counter 86 is programmed to produce a digital signal representative of envelope 44 the modified excitation function 40. This signal is applied to second input 88 of digital multiplier 84. Digital multiplier 84 multiplies the signals present at first and second inputs 82 and 88. The output is a swept rf signal representative of modified excitation function 40. This signal is amplified by amplifier 14 and applied to electrode plates 16 of analyzer cell 10.

Figure 7:
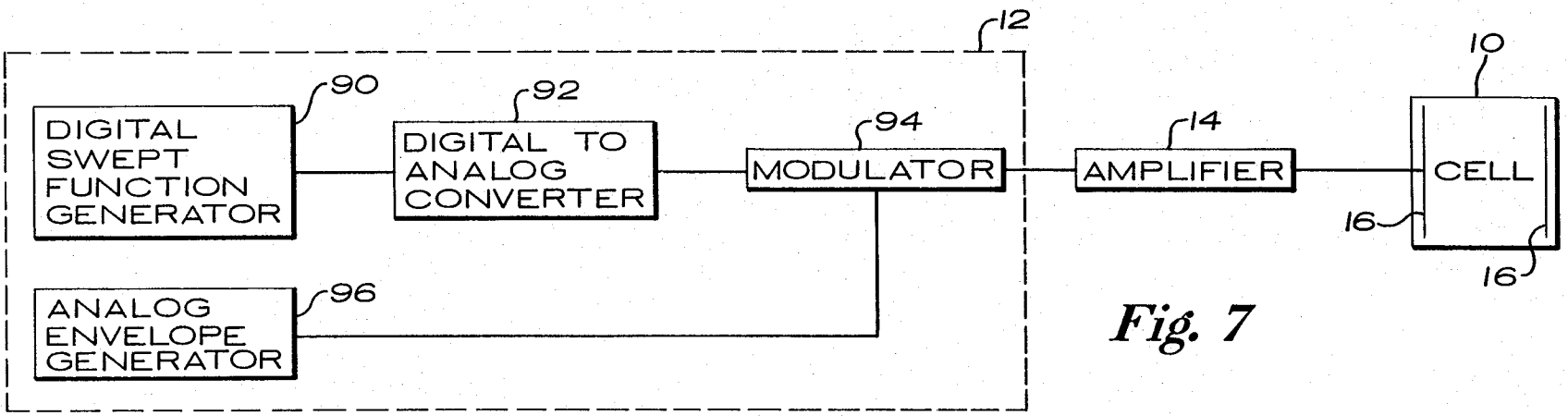
FIG. 7 is a block diagram representation of a fourth preferred embodiment of the signal generator.

FIG. 7 illustrates a fourth embodiment of signal generator 12. Digital swept function generator 90 produces a digital signal representative of a swept rf signal. This signal is converted into an analog signal by D/A converter 92 and input to modulator 94. Analog envelope generator 96 is programmed to produce a signal representative of envelope 44. This signal is input to modulator 94. Modulator 94 produces a swept rf signal representative of modified excitation function 40. This signal is amplified by amplifier 14 and applied to electrode plates 16 of analyzer cell 10.

Figure 8:
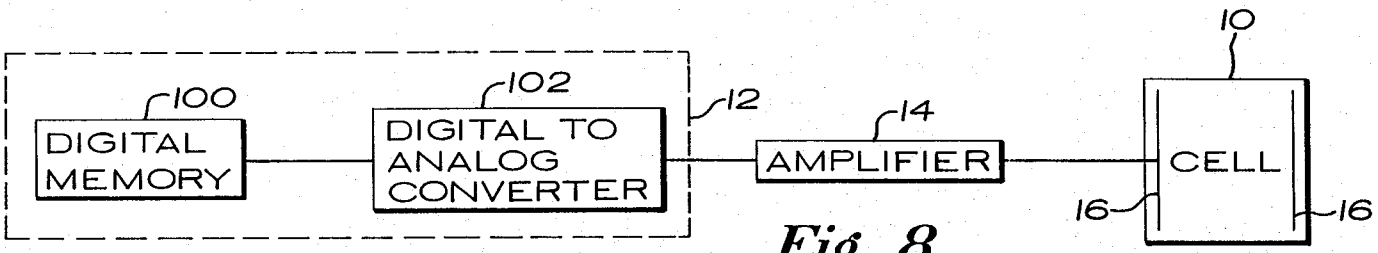
FIG. 8 is a block diagram representation of a fifth preferred embodiment of the signal generator.

Yet another embodiment of signal generator 12 is illustrated in FIG. 8. As shown, signal generator 12 includes digital memory 100 and digital-to-analog (D/A) converter 102. Stored within digital memory 100 is digital data representative of modified excitation function 40, including both swept rf signal 42 and envelope 44. An output of digital memory 100 is a digital signal representative of the modified excitation function 40. This digital signal is converted to an analog signal by D/A converter 102. The analog signal is amplified by amplifier 14 and applied to electrode plates 16 of analyzer cell 10.

In summary, the present invention is a novel system for exciting ions within a mass spectrometer into resonance. The modified excitation function includes onset and termination regions during which an envelope of the swept rf signal ramps gradually between the zero level add the constant-amplitude level. The power spectrum of the modified excitation function exhibits a generally constant amplitude as a function of frequency. All ions having natural cyclotron frequencies of interest are excited into resonance with equal energy. Accuracy of ICR/MS measurements are greatly increased.

Although the present invention has been described with reference to preferred embodiments, workers skilled in the art will recognize that changes may be made in form and detail without departing from the spirit and scope of the invention.

What is claimed:

1. In an ion cyclotron resonance mass spectrometer of the type having means for trapping gaseous ions within an analyzer cell, means for exciting the ions into resonance, and means for detecting the ions, the improvement wherein the means for exciting the ions comprises:

means for producing a swept radio-frequency field having a generally constant-amplitude power spectrum over a range of frequencies of interest and causing the field to have an envelope having an onset region which gradually varies from a first level to a second level.

2. The mass spectrometer of claim 1 wherein the means for producing the' swept radio-frequency field causes the envelope of the field to vary linearly from the first level to the second level during the onset region.

3. The instrument of claim 1 wherein:

the first level is a zero amplitude level; and the second level is a non-zero constant amplitude level.

4. The instrument of claim 12 wherein the onset region has a duration of 20 to 100 microseconds.

5. The instrument of claim 1 wherein the onset region has a duration of approximately 2.5% to 5% of the duration of the swept rf field.

6. The mass spectrometer of claim 1 wherein the means for producing the swept radio-frequency field causes the field to have an envelope having a termination region which gradually varies from a second level to a first level.

7. The mass spectrometer of claim 6 wherein the means for producing the swept radio-frequency field causes the envelope of the field to vary linearly from the second level to the first level during the termination region.

8. The instrument of claim 6 wherein:

the first level is a zero amplitude level; and the second level is a non-zero constant amplitude level.

9. The instrument of claim 6 wherein the termination region has a duration of 20 to 100 microseconds.

10. The instrument of claim 6 wherein the onset region has a duration of approximately 2.5% to 5% of the duration of the swept rf field.

11. The instrument of claim 1 wherein the frequency range of interest is from 0 to 2 megahertz.

12. The instrument of claim 1 wherein variations in the power spectrum range from 99% to 102% of a mid-range frequency value.

13. In an ion cyclotron resonance mass spectrometer of the type having means for trapping gaseous ions within an analyzer cell, means for producing a swept radio-frequency electric field to excite the ions into resonance, and means for detecting the ions, the improvement wherein the means for producing the swept radio-frequency field includes:

means for producing a swept radio-frequency signal having a generally constant-amplitude power spectrum over a range of frequencies of interest and causing the signal to have an envelope having an onset region which gradually rises from a first level to a second level.

14. The mass spectrometer of claim 13 wherein the means for producing the swept radio-frequency signal causes the onset region of the envelope to rise linearly from the first level to the second level.

15. The instrument of claim 13, wherein the means for producing the swept radio-frequency signal causes the onset region of the envelope to have a duration of 20 to 100 microseconds.

16. The instrument of claim 13 wherein the means for producing the swept radio-frequency signal causes the onset region of the signal to have a duration of approximately 2.5% to 5% of a duration of the swept radio-frequency signal.

17. The instrument of claim 13 wherein:

the first level is a zero amplitude level; and the second level is a non-zero constant-amplitude level.

18. The mass spectrometer of claim 13 wherein the means for producing the swept radio-frequency signal causes the signal to have an envelope having a termination region which gradually varies from a second level to a first level.

19. The mass spectrometer of claim 18 wherein the means for producing the swept radio-frequency signal causes the termination region of the envelope to fall linearly from the second level to the first level.

20. The instrument of claim 18 wherein the means for producing the swept radio-frequency signal causes the termination region of the envelope to have a duration of 20 to 100 microseconds.

21. The instrument of claim 18 wherein the means for producing the swept radio-frequency signal causes the termination region of the signal to have a duration of approximately 2.5% to 5% of a duration of the swept radio-frequency signal.

22. The instrument of claim 18 wherein:

the first level is a zero amplitude level; and the second level is a non-zero constant-amplitude level.

23. The instrument of claim 13 wherein the frequency range of interest is from 0 to 2 megahertz.

24. The instrument of claim 13 wherein variations in the power spectrum range from 99% to 102% of a mid-range frequency value.

25. In an ion cyclotron resonance mass spectrometer of the type having:

an analyzer cell for holding a sample;

means for producing gaseous ions of the sample;

means for trapping the ions within the analyzer cell;

means for producing a swept radio-frequency field for exciting the ions into resonance; and means for detecting the resonant ions;

the improvement wherein the means for producing the swept radio-frequency field causes the field to have an envelope of trapezoidal shape including:

an onset region which ramps linearly from a zero level to a non-zero constant-amplitude level;

a constant-amplitude region having the non-zero constant-amplitude level; and a termination region which ramps linearly from the non-zero constant-amplitude level to the zero level.

26. The mass spectrometer of claim 25 wherein the onset and termination regions of the envelope have a duration of 20 to 100 microseconds.

27. The mass spectrometer of claim 25 wherein the onset and termination regions of the envelope have a duration of approximately 2.5% to 5% of the duration of the swept radio-frequency field.

28. The mass spectrometer of claim 25 wherein a power spectrum of the swept radio-frequency field has variations which range between 99% and 102% of a mid-range frequency value.

29. The mass spectrometer of claim 25 wherein the means for producing the swept radio-frequency field comprises:

means for producing a signal representative of the trapezoidal envelope;

means for producing a swept radio-frequency signal;

means for modulating the swept radio-frequency signal by the signal representative of the envelope to produce a swept radio-frequency signal having a trapezoidal envelope; and means for converting the swept radio-frequency signal having the trapezoidal envelope to the swept radio-frequency field.

30. The mass spectrometer of claim 25 wherein the means for producing the swept radio-frequency field comprises:

means for producing a digital signal representative of the swept radio-frequency field having the trapezoidal envelope; and means for converting the digital signal to the swept radio-frequency field.

31. A method for exciting gaseous ions within an ion cyclotron resonance mass spectrometer into resonance including:

subjecting the ions to a swept radio-frequency electric field having an envelope with an onset region which ramps linearly from a zero level to a constant-amplitude level.

32. The method of claim 31 and causing the onset region of the envelope to have a duration of 20 to 100 microseconds.

33. The method of claim 31 and causing the onset region of the envelope to have a duration of approximately 2.5% to 5% of the duration of the electric field.

34. A method for exciting gaseous ions within an ion cyclotron resonance mass spectrometer into resonance including:

subjecting the ions to a swept radio-frequency electric field having an envelope with an termination region which ramps linearly from a constant-amplitude level to a zero level.

35. The method of claim 34 and causing the termination region of the envelope to have a duration of 20 to 100 microseconds.

36. The method of claim 34 and causing the termination region of the envelope to have a duration of approximately 2.5% to 5% of the duration of the electric field.

* * * * *

UNITED STATES PATENT AND TRADEMARK OFFICE

CERTIFICATE OF CORRECTION

PATENT NO. : 4,874,943

DATED : October 17, 1989

INVENTOR(S) : Robert B. Spencer

It is certified that error appears in the above-identified patent and that said Letters Patent is hereby corrected as shown below:

Column 8, line 34, delete "claim 12" and insert --claim 1--.

Signed and Sealed this

Twenty-first Day of May, 1991

*Attest:*

HARRY F. MANBECK, JR.

*Attesting Officer*

*Commissioner of Patents and Trademarks*